US007163501B2

(12) United States Patent
Evminov

(10) Patent No.: US 7,163,501 B2
(45) Date of Patent: Jan. 16, 2007

(54) EVMINOV'S PREVENTER TRAINING DEVICE ESSENTIALLY FOR USING IN BACKBONE TREATMENT AND A METHOD FOR PREVENTING AND TREATING DEFORMATIONS AND DEGENERATIVE DISEASES OF THE BACKBONE

(76) Inventor: Vyacheslav Evminov, 3, ul. Serafimovicha, app. 101, Kyiv, 02152 (UA)

( * ) Notice: Subject to any disclaimer, the term of this patent is extended or adjusted under 35 U.S.C. 154(b) by 267 days.

(21) Appl. No.: 10/240,179

(22) PCT Filed: Mar. 30, 2001

(86) PCT No.: PCT/UA01/00009

§ 371 (c)(1),
(2), (4) Date: Sep. 26, 2002

(87) PCT Pub. No.: WO01/72257

PCT Pub. Date: Oct. 4, 2001

(65) Prior Publication Data

US 2004/0235627 A1 Nov. 25, 2004

(30) Foreign Application Priority Data

Mar. 30, 2000 (UA) ..... 200031835

(51) Int. Cl.
*A63B 71/00* (2006.01)

(52) U.S. Cl. ..... 482/148; 482/904; 482/39

(58) Field of Classification Search ..... 482/134, 482/148, 39, 904; 446/220
See application file for complete search history.

(56) References Cited

U.S. PATENT DOCUMENTS

| | | | | |
|---|---|---|---|---|
| 3,501,140 | A * | 3/1970 | Eichorn | 482/130 |
| 5,643,152 | A * | 7/1997 | Simonson | 482/100 |
| 6,767,314 | B1 * | 7/2004 | Thompson | 482/96 |
| 2001/0004624 | A1 * | 6/2001 | Cournoyer | |

* cited by examiner

*Primary Examiner*—Lori Amerson
(74) *Attorney, Agent, or Firm*—Weiner & Burt, P.C.; Irving M. Weiner; Pamela S. Burt

(57) ABSTRACT

The inventive device comprises a shelf for inclining said device on the upper and lower footings thereof, and a facility for maintaining a trained person on the tilted shelf in a lying position. The keeping maintenance facilities is mounted on the shelf and embodied in such a way that the projection of the midbackbone of a trained person matches the middle of the spacing of the shelf. Said shelf is embodied in such a way that the shelf sags in the middle of the spacing thereof within a range of 0.5–5% of the spacing length, the trained person being placed in a required region and position. The inventive method for preventing and treating deformations and degenerative diseases of the backbone provides a backbone extension performed on a special device and a training of base muscles supporting the backbone. In accordance with the invention, while the backbone is extended short muscles thereof are also trained.

2 Claims, 2 Drawing Sheets

EVMINOV'S PREVENTER TRAINING DEVICE ESSENTIALLY FOR USING IN BACKBONE TREATMENT AND A METHOD FOR PREVENTING AND TREATING DEFORMATIONS AND DEGENERATIVE DISEASES OF THE BACKBONE

FIELD OF THE INVENTION

The invention relates to a training device suitable for outdoor and indoor physical exercises, including premises having a very small space, and to methods for preventing and treating deformations (in anteroposterior and lateral directions) and degenerative diseases of the backbone, using similar devices.

According to the data obtained in the course of numerous studies, at least two-thirds of the world population are to some extent suffering from the above diseases. Deformations in the anteroposterior direction include kyphotic deformations, deformations caused by osteochondropathy of vertebral bodies (Calve's disease), deformations in osteochondropathy of apophyses of vertebral bodies (Scheierman-Maw disease), Kummel's diseases etc. One of lateral deformations, namely the deformation combined with the torsion of vertebrae, is known under the name of scoliosis.

Intervertebral osteochondrosis (discopathy) relates to the most widespread degenerative diseases of the backbone. This type of diseases also includes diskosis, deforming spondylarthritis, spondylosis, Bostrup's disease etc.

PRIOR ART

All the known nonsurgical methods for preventing and treating deformations and degenerative diseases of the backbone generally involve two kinds of effects: a) backbone extension, and b) training base muscles supporting the backbone.

In particular, such effect is manifested in the use of curative swimming; this method yields positive results but is insufficiently effective due to nonuniform and insufficient extension of various sections of the backbone. In addition, the process of swimming results in the training of various muscular groups (such as muscles of back, upper shoulder girdle, legs etc.), which fact does not permit to concentrate only on those muscles that support the backbone. As a result, such treatment takes a rather long period of time and is not always successful.

Known in the art are training devices that may be used for preventing and treating deformations and degenerative diseases of the backbone, such devices comprising a shelf provided for mounting in an inclined position on upper and lower footings thereof, and means for retaining a trainee in the reclining position on the span portion of the inclined shelf. The above means may comprise an attachment to be gripped with hands, the role of such attachment being played by horizontal bar members of the wall bars, which also serve as the upper footing for the shelf similarly to the device disclosed in the European Patent Application, EP No. 0011017. In another embodiment, the attachment for gripping comprises handles attached to a frame mounted on a premise wall, said frame also serving as the upper footing for the shelf and being a kind of wall bars (Patent Application EP No. 0236595).

Although the above devices may be adjusted for backbone extension and training of base muscles supporting the backbone, their application involves certain problems. The major one consists in that the means for retaining a trainee on the shelf is not incorporated in the shelf design since the handles are either attached to the shelf mounted on the wall or constitute elements of the wall bars. This results in a complication of the whole device (carrying out physical exercises requires the shelf and wall bars), and (which is the most essential) does not permit "correct" placement of the trainee on the shelf.

The term "correct" means such a position of a person lying on the shelf, in which the projection of the midbackbone matches the midpoint of the span portion of the shelf. We have come to this conclusion in the course of analysing the most successful and fast recoveries of patients suffering from deformations and degenerative diseases of the backbone. Obviously, the use of the above devices makes it quite difficult to achieve the required position of a trainee on the shelf since various persons differ in height, arms length etc. Of course, it is possible to make use of telescopic attachments to be gripped with hands; such arrangement however will further complicate the design of the device.

Experiments and observations have permitted us to draw another conclusion that is directly associated with the previous one: the process of treatment is much more successful provided that the shelf features certain flexibility parameters. It is clear that the shelves used in the above-described devices and having an extremely low extent of deflection, i.e. being actually rigid, did not allow effective treatment of patients. It is also obvious that in the use of rigid shelves, the "correct" position of patients was not of significant importance since the shelf actually did not deflect.

DISCLOSURE OF THE INVENTION

The object of one of the group of the inventions consists in providing a training device mainly intended for use on backbone, devoid of the above-listed drawbacks of the known prior art devices, and suitable for effective use in prevention and treatment of deformations and degenerative diseases of the backbone.

Another invention of the above group is aimed at providing a method for preventing and treating deformations and degenerative diseases of the backbone, in which the use of the inventive device would substantially increase the effectiveness of prevention/treatment, accompanied by concurrent decrease in the treatment duration.

The first object is attained by that in a training device mainly intended for use on backbone and comprising a shelf provided for mounting in an inclined position on upper and lower footings thereof, and a means for retaining a trainee in the reclining position on the span portion of the inclined shelf, according to the invention the above means is disposed on the shelf and provided for matching the projection of the midbackbone of the trainee with the midpoint of the span portion of the shelf, and the shelf is provided for deflection in the midpoint of the above span within the range of 0.5 to 5% of the span length while the trainee is disposed in the above location and position.

The above-mentioned distinctions of the inventive device allow the drawbacks of similar prior art devices to be successfully eliminated, and namely permit to provide a simple device suitable for carrying out numerous physical exercises, including those intended for training the backbone, the latter exercises being especially effective in the prevention and treatment of deformations and degenerative diseases of the backbone.

In fact, mounting the above means on the shelf eliminates the need in bulky structures of the wall bars type, which provided support for the shelf and at the same time served as the location for mounting of said means (or served as such means themselves). By using simple attachments that perform supporting functions (to be explained below) and are fastened to the shelf, it is possible to ensure reliable clamping of said shelf in the inclined position. On the other hand, combination of preset flexibility of the shelf and such design of the means for retaining that permits matching of the projection of the midbackbone of the trainee with the midpoint of the span portion of the shelf, ensures a required effectiveness of treatment and prevention.

The above value of deflection has been found empirically. In the process of experiments we have found that the value of deflection below 0.5% from the span length actually does not allow the treatment effectiveness to be upgraded. At the same time, exceeding this value above 5% may cause negative results of treatment. In addition, according to the invention the optimal value of deflection amounts to 2–3%.

Also, in one preferred embodiment of the invention the means for retaining a trainee in the reclining position on the span portion of the inclined shelf is made in the form of handles provided for displacement relative to the shelf and for clamping in a required position. Such a design of the above means is actually preferable since extension of the backbone can be carried out more effectively under the effect of the own weight of a person who, having gripped the handles with his/her hands, is lying on the inclined shelf with his/her head above the feet level or, having gripped the above handles with his/her feet, is lying with his/her head below the feet level. In addition, such position permits convenient training of muscles supporting the backbone, and especially short muscles of the backbone, which will be described in more detail below.

According to the invention, displacement relative to the shelf may include either longitudinal or combined longitudinal/height-oriented displacement. In addition, the handles may be hingedly connected to the shelf, and such hinge may be made universal, i.e. provided with three degrees of freedom. In this case, the handles may be mounted at an angle to the shelf plane, and each handle may be mounted at a different angle thereto.

With the aim of mounting the device on upper and lower footings, the shelf is provided with an attachment for suspending one of the ends thereof from the upper footing; here, the other end of the shelf is provided for free bearing against the lower footing.

According to one embodiment of the invention, the above attachment is provided in the form of at least one stop member fastened at one end of the shelf and provided for bearing against the upper footing. The stop member may be provided for interaction with stop members mounted on the upper footing in spaced relationship in the height direction. Such design is convenient if the premise is provided with wall bars-type equipment.

According to another embodiment of the invention, the above attachment is provided in the form of a line adapted for fastening to the shelf and for reeving on a pulley fastened on the upper footing, and provided with a device for stopping motion thereof.

Finally, according to still another embodiment of the invention, the above attachment is provided in the form of an axial strap fastened on the back side of the shelf and provided with fastening members disposed in spaced relationship in the length direction of said shelf, and at least one line with one end thereof adapted for fastening on the upper footing, while the other end is adapted for making a lock joint with the strap fastening members. Such arrangement permits to provide a compact training device that occupies a minimal space when being in non-working condition.

According to the invention, the shelf may be also equipped with a platform to accommodate a trainee; said platform may be mounted on the shelf for reciprocal motion and in addition provided with members adapted for contact massaging and/or vibrational and/or electrotherapeutical and/or magnetotherapeutical and/or medicinal effect on a trainee, thereby extending functional capabilities of the device.

Besides, the shelf may be provided with a supporting platform for trainee's legs, thereby allowing the range of exercises to be essentially extended.

Finally, the shelf may be provided with a "Glisson's loop" connected thereto by means of an elastic rod. The above "loop" is intended for training of the cervical portion of the backbone; such training may be carried out either concurrently with or separated from the training of other portions of the backbone. Here, the elastic rod permits slight and controllable extension of the cervical portion of the backbone.

The second object of the invention is attained in that in a method for preventing and treating deformations and degenerative diseases of backbone, providing backbone extension on an device adapted therefor, and exercising of base muscles supporting the backbone, according to the invention extension of the backbone is carried out with the use of any of the embodiments of the above device (i.e. the device disclosed in any of claims 1 through 17), said extension being carried out concurrently with exercising of short muscles of the backbone.

We have noticed that the above exercising is much more effective and trauma-safe in cases where it is carried out on equilibrated backbone, i.e. in the process of extension, which fact is apparently associated with a concurrent decrease in the pressure within intervertebral disks. Here, purposeful exercising of a not very big group of muscles responsible for creating a muscular jacket around vertebrae (these generally include short *musculi interspinales, musculi spinalis, musculi semispinalis*, and *musculi transversospinalis*) also considerably increases treatment effectiveness and reduces its duration.

It should be particularly noted that short muscles are far less subject to fatigue than the long ones. This feature of short muscles provides the possibility of a long-term training during one training session. Such a long training results in a considerable stirring up of metabolic processes in the backbone area, and hence in intensified nourishment of osseous and fibrous tissues.

Thus, simultaneous effect of two factors, i.e. extension accompanied by formation of an equilibrated area in the intervertebral space, and intensified diffusive nourishment in this area, results in regeneration of vertebral tissues, thereby also eliminating various deformations of the backbone. In case of a healthy backbone, the above effect is preventing and may serve both as a means for attaining one of the most important parameters of healthy backbone, i.e. stabilization of the height of an adult person during his/her lifetime, and a tool for purposeful increase of this height (particularly during childhood and youth).

In addition, according to the invention the extension of the backbone is controlled, which can be easily done by way of varying the inclination of the shelf, and is quite essential for measuring out the degree of extension of the backbone depending on the intensity of exercising load, severity of disease etc.

A considerable share of advantages provided by this method is ensured by the device used therefor. The positive role of a shelf having a certain extent of flexibility in the prevention and treatment of backbone diseases has been mentioned above. This statement may be added by the fact that in the use of the embodiment of the invention in which the shelf is suspended from the footing by a line having a certain degree of elasticity (generally speaking, lines made of any material feature certain elasticity, but lines made of polymeric materials, e.g. kapron, comply with this condition to the highest extent), therapeutic effect of the method is also increased.

Taking into consideration the above advantages of the inventive device, it is possible to compare its role in preventing and treating deformations and degenerative diseases of the backbone with the role of a toothbrush in the prevention of caries, paradontosis etc. Considering such device as a "toothbrush for backbone" won't constitute a considerable overstatement. This fact may explain the advertising name, "Evminov's Preventer", chosen for this device. Generally speaking, the above-described devices may be implemented as follows. The device comprises a shelf, e.g. made of wood, whose width is governed by the distance between shoulder blades and protruding hipbones, and the length exceeds the height of a person by 30 to 40%. The object of such arrangement is to prevent the person "suspended" on the inclined shelf on stretched-out arms from reaching the lower footing (floor) with his/her feet. Thickness of the shelf is preferably small to ensure the required flexibility. To this end, the shelf is made with the use of a special technology, e.g. similar to that of making racing skis.

Optimal embodiment of the means disposed on the shelf and intended for retaining a trainee comprises handles. Nevertheless, in a number of cases it may be made as shoulder straps, belts, clamps for special clothing worn by a trainee etc.

Handles may be of any convenient design; however bicycle handle bars would be preferable. Such handles should be mounted for displacement in the direction of the shelf length. It would be also preferable to provide these bars with the possibility of displacing in the height direction and relative one another. In such case, it would be possible to treat serious deformations of the backbone in the lateral direction.

The shelf is fixed on the upper footing either by suspension from said upper footing (in this case, ceiling or wall of premises may serve as such footing), or by bearing against such footing. Here, the footing should be substantially vertical (a wall provided with supporting elements, wall bars etc.).

In some cases it is expedient to provide the footing with a platform to accommodate a trainee; said platform may move along the shelf and exert, through the use of special attachments, a therapeutical effect on the trainee, massage being the most widespread type of such effect.

"Glisson's loop" is designed for carrying out exercises aimed at the training of the cervical section of backbone; it is fastened on the head; connects, due to the availability of an elastic rod, said "loop" to the shelf, and permits carrying out extension of the cervical section of backbone.

Given below is a detailed description of an embodiment of the invention. Its operation will be disclosed in the description of the method for preventing and treating deformations and degenerative diseases since the operation of the given device comprises a process mainly intended for exercising the backbone and serving, under certain conditions of embodiment thereof, attainment of objects of the above prevention and treatment. It should be added that the above device may be used for carrying out exercises aimed at training of not only backbone but also prelum abdominale, other muscles of trunk, arms etc.

Here, it should be kept in mind that specific examples of embodiment of the device (including drawings) and the method should be in no case considered as restricting the scope of invention as set forth in the appended Claims.

BRIEF DESCRIPTION OF DRAWINGS

Now the invention will be further explained by means of accompanying drawings, in which.

DETAILED DESCRIPION OF THE INVENTION

Figure 3:
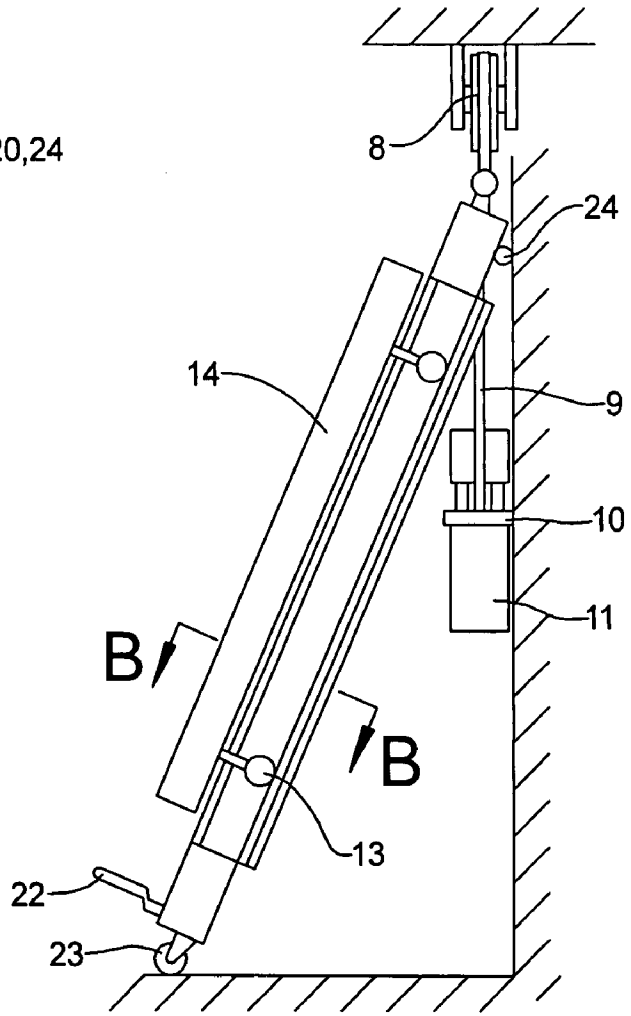
FIG. 3 is a general view of the device provided with a line, a pulley, and a carriage.
Figure 2:
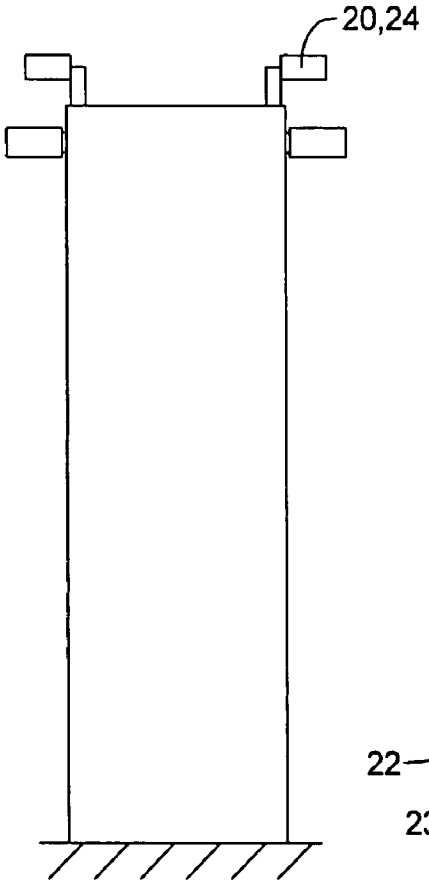
FIG. 2 is a side general view.

The device comprises shelf 1 whose lower end loosely bears against the lower footing means 30, i e., floor, ground, etc. The upper end of the shelf loosely bears against the upper footing, a wall, by means of stop 2 fixed on the shelf, and bracket 3 fixed on the wall. The bracket 3 is provided with several stop members 4 mounted in spaced relationship in the height direction. To expand the range of adjustment of shelf position, the bracket is provided with a number of openings 5 for detachable fastening to footing 6 having similar openings. Fastening is carried out by means of pin 7.

In the embodiment of the device shown in FIG. 3, shelf 1 is fastened to the upper footing, i.e. ceiling or a wall of the premise, by means of pulley 8 fastened thereto, and line 9 with stop 10 for limiting motion thereof and adjustable along the height of support member 11.

Fastened to side surfaces of shelf 1 are guides 12 along which the platform for placing a trainee may move on rollers 13; said platform may be made in the form of carriage 14. Clamps 15 are provided for locking the movement of carriage 14.

Figure 6:
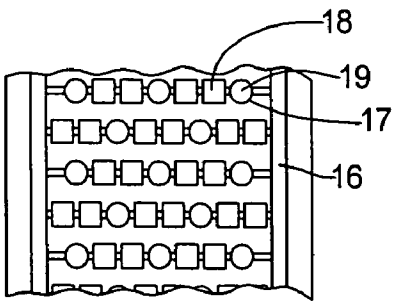
FIG. 6 is a fragment of the face and shelf provided with massaging elements.
Figure 4:
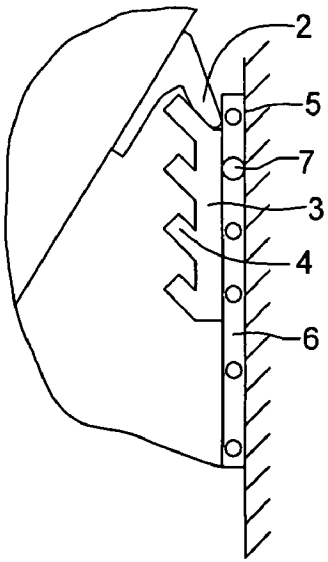
FIG. 4 is assembly A from FIG. 1 (handles are not shown).

In the embodiment of the device shown in FIG. 6, the platform for placing a sportsman is provided with a section shaped as frame 16 inside which rollers 18 and balls 19 are mounted on axles 17 to provide massaging in the course of carrying out exercises.

Figure 1:
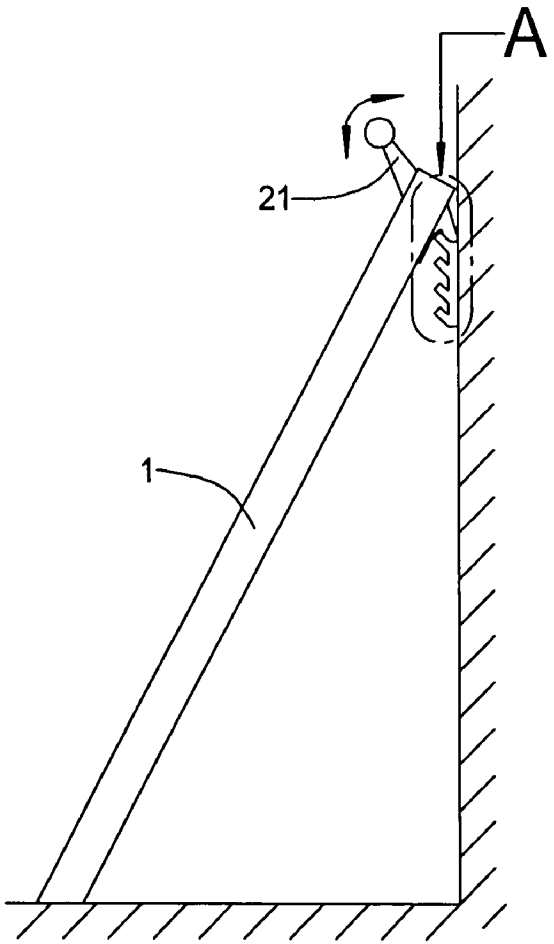
FIG. 1 is a general view of the exercise device in working condition, provided with a stop and a bracket.

Handles 20 are disposed on shelf 1. Brackets 21 of handles 20 are fastened on shelf 1 for rotating as shown in FIG. 1. They may be mounted inside grooves of shelf 1 for displacement along said shelf (over the whole length or a part thereof) and for clamping in a required position. With the aim of improving the comfort and extending functional capabilities, supporting platform 22 for feet and rollers 23 are fixed in the lower portion of the shelf. To ensure better preservation of a wall or any other vertical support, rollers 24 are provided.

Figure 7:
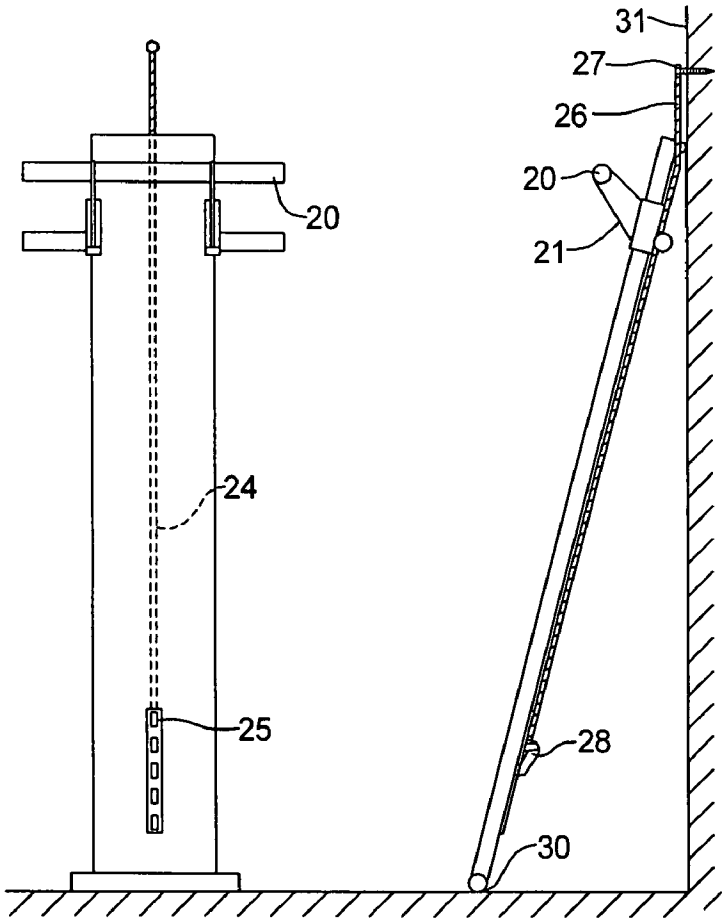
FIG. 7 is a general view of the device provided with a line and a strap.
Figure 5:
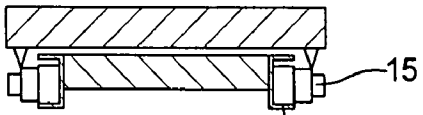
FIG. 5 is section B—B from FIG. 3.

Shown in FIG. 7 is one of the most preferred embodiments of the device being of a simple design, compact and at the same time very functional. Fastened on the rear side of shelf 1 is axial strap 24 provided with fastening members whose function is performed by walls of openings 25 provided in strap 24 in spaced relationship in the direction of the length thereof. Also provided is line 26 with one end thereof adapted for fastening to dowel 27 driven into the wall or upper footing means 31. The other end of line 26 is provided with hook 28 to form a lock joint with the walls of openings 25.

EMBODIMENT OF THE INVENTION

A method for preventing and treating deformations and degenerative diseases of the backbone is implemented on the given device as follows. To bring the device ("preventer") to the operational condition, one end of shelf 1 must bear against a stationary horizontal footing, e.g. floor, while the other end disposed closer to brackets 21 of handles 20 is fixed at a certain height above the floor, e.g. by means of stop 10 for limiting motion of line 9. In the use of the device shown in FIG. 7, the angle of inclination of shelf 1 is adjusted by way of using certain openings 25 to engage hook 28.

In compliance with the above-mentioned concept of gradual approach, extension and training should start at an angle of inclination of up to 15° between the "preventer" and the horizontal surface since the greater the angle, the more intense is extension and hence the higher the risk of injuries caused by training (for certain exercises, e.g. free "droops", the inclination angle of the "preventer" may be even "negative", i.e. amount to less than 90°). Here, brackets 21 with handles 20 are mounted at such height that does not permit a trainee lying on the shelf to reach the floor with his/her feet. Given below is a possible set of exercises that ensure training of short muscles of the backbone in the process of extending.

1. Inclination angle of the preventer is 5–15°. Initial position: trainee is lying with his back on the preventer, hands being on the handles. Self-extension is accomplished through relaxation of short muscles of the backbone. Returning to the initial position.

2. Inclination angle of the preventer is 5–15°. Initial position: trainee is lying with his back on the preventer, hands being on the handles. Alternate tension and relaxation of left and right groups of short side muscles of the backbone.

3. Inclination angle of the preventer is 5–15°. Initial position: trainee is lying with his back on the preventer, hands being on the handles. Alternate tension and relaxation of front and rear groups of short side muscles of the backbone.

4. Inclination angle of the preventer is 5–15°. Initial position: trainee is lying with his back on the preventer, hands being on the handles. Undulating, with a small amplitude, deflections of the backbone in anteroposterior (like in butterfly-style swimming) and lateral (snake-like motion) directions.

5. Inclination angle of the preventer is 15–60°. Initial position: trainee is lying with his back on the preventer, hands being on the handles. Both legs should be simultaneously lifted up to chest level by bending them in knee-joints. Such position should be fixed for 5 to 10 seconds. Following this, to lower legs and to return to the initial position. This exercise should be repeated 4 to 8 times.

6. Inclination angle of the preventer is 5–30°. Initial position: trainee is lying with his back on the preventer, hands being on the handles. Legs should be slowly taken to the right by an angle of 10–15°. Such position should be kept for 5 to 15 seconds. The trainee should not either bend his/her arms or pull himself/herself up. Returning to the initial position. In the same way, legs should be taken to the left. This exercise should be repeated 6 to 8 times.

7. Inclination angle of the preventer is 15–50°. Initial position: trainee is lying with his stomach on the preventer, hands being on the handles. Legs should be lifted to the maximum extent above the preventer plane without bending them in knees. Such position should be kept for 3 to 5 seconds. Returning to the initial position. This exercise should be repeated 4 to 8 times.

The above list of exercises is not exhaustive. Upon having acquired certain skills, a trainee may amend this list with his/her own exercises, being guided by his/her own sensations and recommendations provided by experts.

The invention claimed is:

1. A training device for use in treating a backbone of a trainee user, comprising, in combination:

a shelf mounted in an inclined position;

retaining means for retaining said trainee user in a reclining position on a span portion of said inclined shelf;

said retaining means is connected to said shelf to match a projection of a midbackbone of said trainee user with a midpoint of said span portion of said shelf said shelf is constructed to deflect the said midpoint of said span portion within a range of 0.5 to 5% of the span length while said trainee user is disposed in said reclining position; and said retaining means includes handles displaceably connected along the length of said shelf and their fixation in a chosen position.

2. A training device for use in treating a backbone of a trainee user, comprising, in combination:

a shelf mounted in an inclined position;

retaining means for retaining said trainee user in a reclining position on a span portion of said inclined shelf;

said retaining means is connected to said shelf to match a projection of a midbackbone of said trainee user with a midpoint of said span portion of said shelf said shelf is constructed to deflect the said midpoint of said span portion within a range of 0.5 to 5% of the span length while said trainee user is disposed in said reclining position;

said shelf is provided with a platform to accommodate said trainee user; and said shelf platform is mounted on said shelf for reciprocal motion relative to said shelf.

* * * * *